United States Patent [19]

Uehara et al.

[11] Patent Number: 4,867,226

[45] Date of Patent: Sep. 19, 1989

[54] METHOD OF OSCILLATING CONTINUOUS CASTING MOLD AT HIGH FREQUENCIES AND MOLD OSCILLATED BY SUCH METHOD

[75] Inventors: Masatsugu Uehara; Haruo Kitamura; Kenzo Sawada; Tetsuo Nakamura; Takashi Ishizawa, all of Kitakyushu City; Katsuhiko Yui, Kimitsu City; Yuichi Kato, Kimitsu City; Ryuichi Hiratsuka, Kimitsu City; Daijiro Mizukoshi, Kimitsu City; Masamitsu Wakoh, Kimitsu City; Junichi Kinoshita, Kimitsu City, all of Japan

[73] Assignee: Nippon Steel Corporation, Japan

[21] Appl. No.: 237,740

[22] Filed: Aug. 29, 1988

[30] Foreign Application Priority Data

| | | | |
|---|---|---|---|
| Aug. 29, 1987 | [JP] | Japan | 62-214174 |
| Aug. 29, 1987 | [JP] | Japan | 62-214175 |
| Aug. 29, 1987 | [JP] | Japan | 62-130881 |
| Aug. 29, 1987 | [JP] | Japan | 62-130879 |
| Nov. 5, 1987 | [JP] | Japan | 62-278194 |

[51] Int. Cl.[4] ..... B22D 11/04

[52] U.S. Cl. ..... 164/478; 164/150; 164/154; 164/416; 164/452

[58] Field of Search ..... 164/478, 416, 452, 150, 164/154

[56] References Cited

U.S. PATENT DOCUMENTS

| | | | |
|---|---|---|---|
| 4,460,034 | 7/1984 | Saeki et al. | 164/478 |

FOREIGN PATENT DOCUMENTS

| | | | |
|---|---|---|---|
| 54-109030 | 8/1979 | Japan | 164/416 |
| 54-112336 | 9/1979 | Japan | 164/416 |
| 59-6735 | 2/1984 | Japan . | |
| 59-189041 | 10/1984 | Japan | 164/416 |
| 59-197348 | 11/1984 | Japan . | |
| 59-197351 | 11/1984 | Japan . | |
| 61-276749 | 12/1986 | Japan | 164/478 |
| 62-57742 | 3/1987 | Japan . | |

*Primary Examiner*—Nicholas P. Godici
*Assistant Examiner*—J. Reed Batten, Jr.
*Attorney, Agent, or Firm*—Wenderoth, Lind & Ponack

[57] ABSTRACT

A method of oscillating a continuous caster mold at high frequencies comprises disposing a plurality of oscillators having substantially the same oscillating characteristic at appropriate intervals along or in the vicinity of a line where liquid metal contacts an inner lining of a mold, connecting the tip of each oscillator to the inner lining so that the axis of the oscillator extends at right angles to the surface of the inner lining, and supplying power from an oscillation generator to each oscillator so that the oscillation frequencies of any two adjoining oscillators are differentiated within the limit of 2 KHz. Thus, any two adjoining oscillators oscillate the inner lining at right angles to the surface thereof at mutually differentiated frequencies.

11 Claims, 12 Drawing Sheets

| | | | | |
|---|---|---|---|---|
| ARRANGEMENT | SYMBOL | a | b | c |
| | FREQUENCY (KHz) | 19.3, 18.7, 18.1 | 19.3, 18.7, 18.1 | 18.7, 18.5, 18.3 |
| | OSCILLATOR NO. | a b c d | a b c d | a b c d |
| | MEAN AMPLITUDE | 1.58 μm | 1.67 μm | 2.43 μm |
| | TROUGH AMPLITUDE | 0.43 μm | 0.59 μm | 1.28 μm |
| EVALUATION | | × | × | ◎ |

METHOD OF OSCILLATING CONTINUOUS CASTING MOLD AT HIGH FREQUENCIES AND MOLD OSCILLATED BY SUCH METHOD

BACKGROUND OF THE INVENTION

1. Field of the Invention

This invention relates to methods of oscillating molds for continuous casting at high frequencies and molds oscillated by such methods. More particularly, it relates to methods of oscillating at high frequencies molds that are used in the continuous casting of billets, blooms and slabs of metals and molds that are oscillated at high frequencies while such semi-finished products of metals are being continuously cast.

2. Description of the Prior Art

It has been known to provide a larger number of high-frequency ocillating means (hereinafter called oscillators) on the mold to oscillate the inner wall of the mold near the meniscus of liquid metal during the continuous casting operation, as, for example, is disclosed in Japanese Provisional Patent Publication No. 55742 of 1987.

FIG. 1 shows an example of a continuous caster mold 1 provided with oscillators 9*a* to 9*l*. The mold 1 has an inner lining of copper 4 on the inside of broad-face plates 2 and narrow-face plates 3. The inner lining 4 is oscillated by the oscillators 9*a* to 9*l* connected thereto. To prevent the seizure or sticking of liquid metal to the inner lining of the mold 1, it is necessary to continuously oscillate the entire surface of the inner lining 4 of the mold 1 near the meniscus at desired frequencies. To the oscillators 9*a* to 9*l* are connected a frequency generator 6, a power setter 7 and an amplifier 8 successively, as shown in FIG. 2. The frequency generator 6, power setter 7, amplifier 8 and oscillators 9*a* to 9*l* constitute a set of oscillating means 5. The oscillating means 5 sets the frequency and power with which the inner lining 4 is oscillated.

Oscillators having the same oscillating characteristics are commonly employed. Furthermore, a set of oscillators used in the conventional oscillating methods accomplish oscillation with the same frequency. Therefore, the high-frequency waves transmitted from the oscillators A and B interfere with each other at the interface between the inner lining 4 and liquid metal or the solidified shell M, as shown in FIG. 3. If the high-frequency waves from the two sources are of the same phase, the amplitude of frequency will be doubled to cause violent oscillation at point $P_1$ on the inner lining that is at distance $AP_1=BP_1$. On the other hand, the amplitude at point $P_2$ where $AP_2-BP_2=\lambda/2$ (where $\lambda$=wavelength of high-frequency wave) will become very small, with the high-frequency waves from the oscillators A and B offsetting each other. The result is the occurrence of seizure or sticking.

Graph (a) of FIG. 4 shows how offsetting occurs at point $P_1$. Dotted line shows the high-frequency wave from the oscillator A, chain line shows that from the oscillator B, and solid line indicates the composite wave obtained by combining the two, all at point $P_1$. Similarly, graph (b) of FIG. 4 shows the offsetting condition at point $P_2$.

In the method of oscillating a mold provided with a plurality of oscillators according to Japanese Provisional Patent Publication No. 57742 of 1987, the difference between the high-frequency waves generated by adjoining oscillators for the oscillation of the inner lining is kept within the limit at which beat is produced.

The frequency of the waves generated by one oscillator can be varied by controlling the frequency setter. But if the frequency of an oscillator (of the electrostrictive or magnetostrictive type) that produces the maximum amplitude at frequency $f_0$ is lowered under $(f_0-1)$ KHz or raised above $(f_0+1)$ KHz, the amplitude will become very small as shown in FIG. 5. The method of Japanese Provisional Patent Publication No. 57742 of 1987 greatly varies the frequencies of the individual oscillators. But if the oscillators have the same oscillating characteristic, the amplitude of high-frequency waves produced by some oscillators is then decreased so greatly, as mentioned previously, that the inner lining is not oscillated with large enough amplitudes. If, on the other hand, oscillators of different types having different oscillating characteristics are used, difficult problems will arise in the control and management thereof.

The separately excited oscillation generator that drives the oscillator is an open-loop control system in which power varies with variations in load (or variations in impedance). Therefore, it has been difficult to keep constant the amplitude of oscillation. With light loads, the amplitude of oscillation varies greatly as frequency varies, as indicated by dotted lines in FIG. 6. Such oscillations are commonly controlled by such automatic frequency tracking constant amplitude control circuits as are shown in FIGS. 7 and 8.

This type of automatic frequency tracking constant amplitude control circuits detect the amplitude of oscillation by the use of the following equations expressing the relationships among the voltage $\dot{E}$ at the oscillator terminal, current $\dot{I}$, control impedance $\dot{Z}_d$, speed of the mechanical terminal $\dot{v}$ and coefficient of power $\dot{A}$:

$$\dot{E}=\dot{Z}_d\dot{I}+\dot{A}\dot{v}=(\dot{Z}_d+\dot{Z}_m)\dot{I} \quad (1)$$

$$\dot{Z}_m\dot{I}=\dot{A}\dot{v} \quad (2)$$

As shown above, the impedance of the oscillator is expressed as the sum of the control impedance $\dot{Z}_d$ that is independent of oscillation and the control impedance $\dot{Z}_m$ that depends on oscillation. Therefore, the voltage proportional to oscillation is obtained by subtracting the voltage drop due to the control impedance $\dot{Z}_d$ from the voltage at the terminal of the oscillator. The bridge circuit of an oscillator and impedances $\dot{Z}_1$ to $\dot{Z}_3$ shown in FIG. 7 is an example of concrete sensing methods commonly employed for the detection of the output voltage $\dot{E}_2$ that is proportional to $\dot{Z}_m\dot{I}$.

Automatic frequency tracking is accomplished by means of a closed circuit formed by a high-frequency oscillator amplifier circuit 14 (transfer function in the amplifier circuit: $\dot{\mu}$) and the oscillation sensing circuit shown in FIG. 7, which constitutes a feedback circuit 17 (transfer coefficient in the beedback circuit: $\dot{\beta}$). The oscillating condition in this circuit is as follows:

$$\dot{\mu}\dot{\beta}=1 \quad (3)$$

Then, the frequency to satisfy the following equation is automatically chosen:

$$<\dot{\mu}+<\dot{\beta}=2n\pi(n\text{: integer}) \quad (4)$$

The constant amplitude control circuit shown in FIG. 8 compares, in a voltage comparison control circuit 13, an output signal preliminarily set by the amplitude setter 12 with a signal produced by amplifying the voltage $E_2$ from the oscillation sensing circuit by a voltage input amplifier 18. Then, the voltage comparison control circuit 13 inputs a control signal into the oscillator amplifier circuit 14 consisting of a resonant phase circuit 15 and an output matching inverter 16 to control the output to the oscillator so that constant amplitude is maintained at all times.

With the automatic frequency tracking constant amplitude control, however, it is impossible to arbitrarily vary the frequency of oscillations produced by adjoining oscillators so that the amplitude of oscillations in the area to be oscillated is effectively flattened. This can results in uneven amplitude that leads to seizure and sticking.

Exposed to rapidly flowing cooking water and oscillated at high frequencies, the water-cooled oscillated surface of the inner lining is susceptible to cracking and erosion. Japanese Provisional Patent Publications Nos. 197351 and 197348 of 1984 disclose methods of preventing such cracking and erosion by covering the weak spot in the water-cooled oscillated surface with a sheet of cushioning material or alloyed metal. Although effective in decreasing the occurrence of cracking and erosion, those methods are not without problems. In the course of long-time service, for example, water may penetrate into a space between the attached covering material and the water-cooled oscillated surface, causing erosion. The covering material coming off may clog up the cooling water passage. A more important problem is that the covered portion of the inner lining is not cooled adequately. Such being the case, development of a better oscillated mold capable of withstanding long-time service has been awaited.

Oscillators are usually cooled by water-cooling, air-purging or other means as overheating can result in their breakage. If any of the oscillators malfunctions, the composite oscillation applied to the mold will become different from the originally intended one, thereby impeding the smooth implementation of the continuous casting operation. Permitting no water cooling because of the insulation consideration necessitated by the applied voltage as high as, for example, 4000 $V_{P-P}$, electrostrictive oscillators are cooled by air-purging etc. Because air-purging and other similar cooling methods are not so effective as water-cooling, operation of the electrostrictive oscillators should be watched carefully.

Monitoring of oscillators has been performed by measuring the voltage and current of the power supply servicing the oscillators. But it is difficult for this method to grasp the degree of deterioration in the electrostrictive elements in the oscillators because it does not perform direct measurement of oscillations. Therefore, oscillators often break unexpectedly, offering an obstacle to the continuous casting operation. Another conventional method of monitoring the operation of oscillators measures amplitude with an amplitude detector. But this method is costly because a large number of amplitude detectors and amplifiers must be provided to cover a large number of oscillators attached to the oscillated mold. Furthermore, this method has not been very reliable because amplitude detectors are apt to come off easily. "Handbook of Ultrasonic Technologies" (Nikkan Kogyo Shimbum) discloses, between pages 488 and 490, various types of pickup sensors that can be used for measuring microamplitudes of oscillating solids. But they are costly and difficult to attach. Their sensors are apt to come off during the long-time service. They need much larger installation space than the high-frequency oscillated mold of continuous casters can afford.

SUMMARY OF THE INVENTION

An object of this invention is to provide a method of constantly imparting desirable oscillations to all surface of the inner lining near the meniscus in a continuous caster mold equipped with a large number of oscillators having the same oscillating characteristic by controlling the interference between the high-frequency waves transmitted by the individual oscillators.

Another object of this invention is to provide a method of constantly imparting desirable oscillations to all surface of the inner lining near the meniscus in a continuous caster mold equipped with a plurality of such high-frequency oscillators that the frequencies of oscillations produced by any two adjoining oscillators are differentiated by arbitrarily varying the frequency of each oscillator and permitting a constant amplitude control.

Still another object of this invention is to provide an oscillated mold that produces no cracking or erosion on the water-cooled oscillated surface of the inner lining even if used over a long period of time.

Yet another object of this invention is to provide an oscillated mold equipped with an easy-to-use monitoring device that permits the operator to learn that the individual oscillators on the mold are accomplishing the desired oscillation.

To accomplish the above objects, a method of oscillating a continuous-caster mold at high frequencies according to this invention installs a plurality of oscillators having practically the same oscillating characteristic at appropriate intervals and along a line where the surface of the liquid metal contacts the inner lining of the mold or in the vicinity thereof. The tip of each oscillator is connected to the inner lining so that the axis of the oscillator extends at right angles to the inner lining. Power is supplied to the individual oscillators so that the frequencies of oscillations produced by any two adjoining oscillators are differenciated from each other by not more than 2 KHz. Thus, such two adjoining oscillators oscillate the inner lining at right angles to the surface thereof at different frequencies. The oscillators may be either of the electostrictive type or of the magnetostrictive type.

In the oscillating method just described, one oscillator may be chosen as a base oscillator, with the frequencies of oscillations produced by the other oscillators gradually decreased or increased according to the distance at which such oscillators stand away from the base oscillator. Also, the frequencies of oscillations applied by the individual oscillators on the inner lining may be varied with time, either intermittently or continuously. By choosing a base oscillator, furthermore, a first oscillation mode, in which the frequencies of oscillations produced by the other oscillators are gradually decreased according to the distance at which such oscillators stand away from the base oscillator, and a second oscillation mode, in which the frequencies of oscillations are gradually increased according to the same distance, may be set. Then, the inner lining may be alternately oscillated in the first and second modes that are switched with time, either intermittently or continuously.

To avoid any significant variations in the frequencies of oscillations produced by a plurality of oscillators attached to the oscillated mold, this invention uses oscillators of the same type having the same oscillating characteristic. This facilitates oscillation control and permits reducing equipment cost.

No localized spot of the mold is constantly oscillated with small amplitudes. Instead, the whole mold is throughly oscillated with large amplitudes. This assures smooth inflow of flux, avoids the seizure and sticking between the liquid metal and the mold inner lining and, thereby, prevents the occurrence of such accidents as breakout. The results are an improvement in the surface quality of cast products, the facilitation or elimination of conditioning, and a remarkable improvement in production yield and operation efficiency.

In the above oscillating method, power supply to the oscillators may be performed through a high-frequency output transformer, with the product of the d.c. voltage and d.c. current on the primary side of the transformer controlled so that the amplitude of the produced oscillations is kept constant. It is also possible to detect the d.c. voltage and d.c. current on the primary side of the high-frequency output transformer for use in the feedback control thereof.

The control circuit according to this invention, which controls frequency by a simple separate excitation method and controls amplitude by controlling power supply, is not costly to make and easy to maintain. This invention has made it possible to arbitrarily vary the frequency of individual oscillators and to perform constant amplitude control. Consequently, the entire surface of the mold inner lining near the meniscus can now be oscillated as desired.

A continuous caster mold oscillated at high frequencies is made up of an inner lining fabricated from copper or copper alloy and a backup outer plate, with a cooling water passage proviced between the inner lining and outer plate. The water-cooled surface of the inner lining is nickel-plated. The nicekl-plated surface may further be plated with chromium.

This invention has drastically reduced the cracking and erosion in the water-cooled oscillated surface, thereby remarkably prolonging the service life of the oscillated mold.

The continuous caster mold oscillated at high frequencies according to this invention is also equipped with a temperature sensor to measure the temperature at the surface of the oscillator, a temperature checker that checks if the surface temperature of the oscillator is within the desired range, and an alarm that actuates a signal when the surface temperature is outside the desired range.

These devices assure a more reliable monitoring of the oscillating condition of many oscillators attached to the mold. They make it easier to keep the oscillations produced by the individual oscillators within the desired range. In addition, they provide data on the level of oscillator deterioration through continuous monitoring. All this permits preventing troubles in the continuous casting operation that have heretofore been unforeseeable.

DESCRIPTION OF THE PREFERRED EMBODIMENTS

Now preferred embodiments of this invention applied to the continuous casting of steel blooms will be described in the following:

Mold

Figure 9:
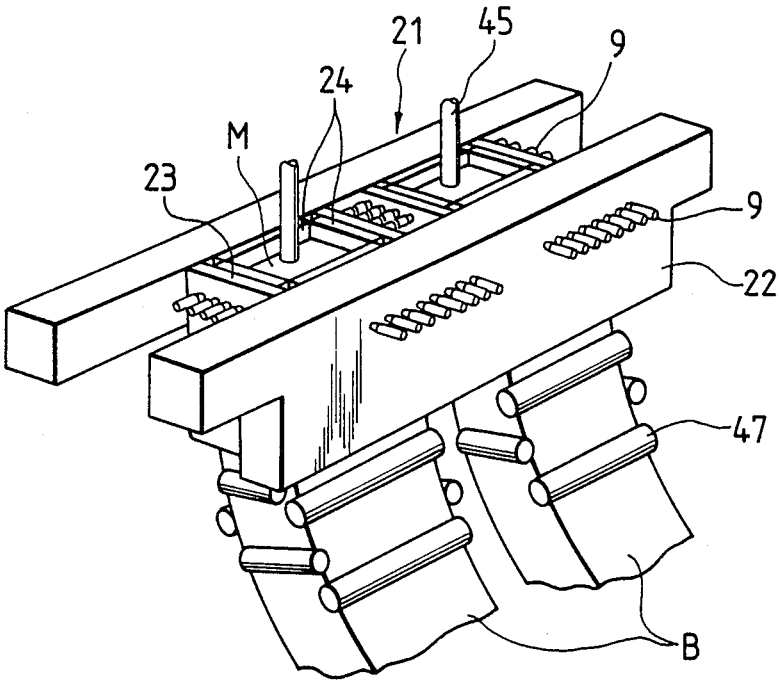
FIG. 9 is a perspective view of a mold for a continuous steel bloom caster equipped with oscillators.
Figure 10:
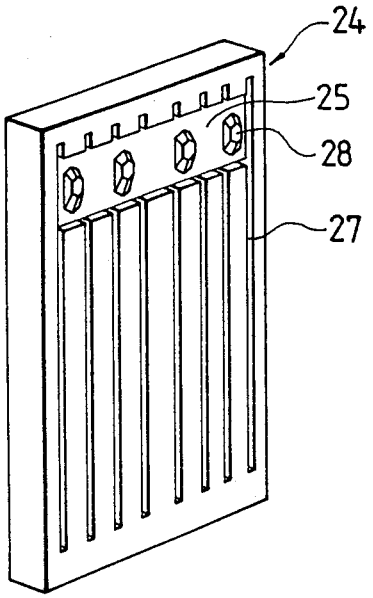
FIG. 10 is a perspective view of an inner lining of a mold.
Figure 11:
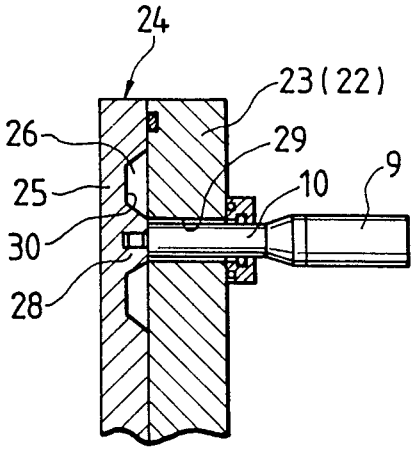
FIG. 11 is a cross-sectional view of a portion of a mold where an oscillator is attached.

FIG. 9 shows a mold and the surroundings thereof. A mold 21 consists of an outer wall made up of broad-face water boxes 22 and narrow-face back plates 23. An inner lining 24 is attached to each of the broad-face water boxes 22 and narrow-face back plates 23 by means of fastening bolts (not shown). The upper portion of the inner lining 24, where thickness is reduced, forms an oscillating segment 25 as shown in FIGS. 10 and 11. There is a juncture 26 of cooling water on the cooled side of the oscillating segment 25. The inner lining 24 also has a plurality of grooves 27 cut in one surface thereof. The junctures 26 and grooves 27, in combination, provide cooling water passages between the inner linings and the broad-face water boxes 22 and narrow-face back plates 23. Cooling water supplied from the broad-face water boxes 22 and narrow-face back plates 23 run through the water passages to cool the inner linings 24. Connecting seats 28 are provided in the oscillating segment 25. The broad-face water boxes 22 and narrow-face back plates 23 also have holes 29 into which connecting rods are inserted. A connecting rod 10 of an oscillator 9 passes through a hole 29. With the tip of the connecting rod 10 screwed into a connecting seat 28, the oscillator 9 is fastened to the inner lining 24. The oscillators 9 are disposed along a line where the surface of liquid metal contacts the inner linings 24 of the mold 21 or in the vicinity thereof, and spaced apart from each other at appropriate intervals.

To ensure that the poured liquid metal forms a sound initial solidified shell, the inner lining 24 is fabricated from copper or copper alloy having high thermal conductivities, and cooled on the outer side. The inner lining 24 is oscillated at high frequencies, as mentioned previously, to prevent the liquid metal from sticking thereto. To lower the temperature at the metal-lining interface and prevent the attenuation of high-frequency oscillations, the thickness of the inner lining 24 should preferably be as thin as possible. The thickness of commonly used inner linings is between a few millimeters and tens of millimeters. The inventors studied the causes for the cracks and erosion that occur in the water-cooled oscillated surface 30. From the studies, it was found that such cracks and erosion were due to what is known as cavitation erosion. The running cooling water and high-frequency oscillation alternately build up high and low pressures in some area of the water-cooled oscillated surface 30. The resulting formation and collapsing of bubbles at and near the interface between the water-cooled oscillated surface 30 and cooling water cause a damage to the water-cooled oscillated surface 30. It was also found that nickel plating or a combination of nickel and chromium plating (with chromium plating provided over nickel plating) is highly effective in preventing such cavitation erosion. While pure nickel plating serves the purpose right, a nickel alloy containing 2 percent to 8 percent of iron is preferable because of the better adherence to copper or copper alloy and the hardness as high as Hv 350. The nickel alloy coating having such properties continuously protects the water-cooled oscillated surface even after an over-coated layer of chromium has worn off. The nickel coating is between 0.01 mm and 1 mm in thickness. Heavier thickness providing greater durability is preferred. The chromium coating provided over an undercoat of nickel is hard enough to provide adequate durability against cavitation erosion. Provided over a nickel coating, the chromium coating adheres firmly enough to provide adequate protection to the water-cooled oscillated surface 30 over a long time. The thickness of the chromium coating usually is between 10 μm and 50 μm. The nickel plating or the combination of nickel and chromium plating may be applied either over the entirety of the water-cooled oscillated surface 30 or over a localized area or areas that are susceptible to heavy cavitation erosion. A life test conducted on the water-cooled oscillated surface 30 of an inner lining 24 covered with a nickel coating of 0.5 mm (containing 7.1 percent iron) and further with a chromium coating of approximately 30 μm proved that the surface would remain undamaged for 3000 hours.

Oscillating Device

Figure 12:
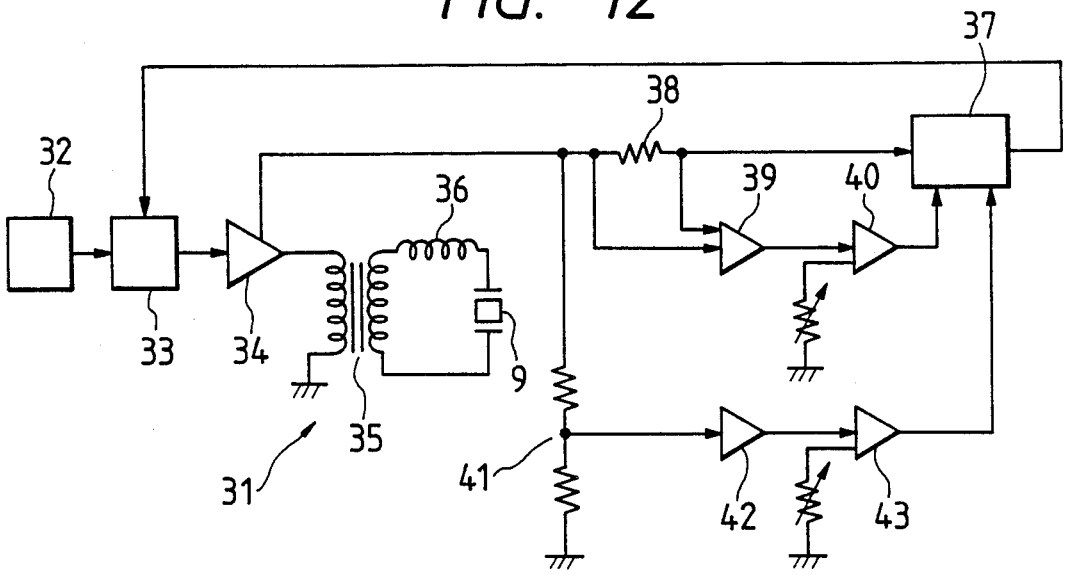
FIG. 12 is a block diagram showing a preferred embodiment of an oscillating device according to this invention.

As shown in FIG. 12, an oscillating device 31 comprises a frequency generator 32, a power setter-comparator 33, an output matching inverter 34 and an output transformer 35 that are connected one after another. When a power setting signal is actuated, the output matching inverter 34 supplies power to an oscillator 9 through the output transformer 35 and an impedance matching coil 36. A shunt 38 and a voltage divider 41 are connected to the output matching inverter 34. While the shunt 38 detects the current on the primary side of the output transformer, the voltage divider 41 detects the voltage thereon. Signals actuated on detecting such current and voltage are amplified by amplifiers 39 and 42 and then input into a power control circuit 37 through arithmetic circuits 40 and 43. The function of the arithmetic circuits 40 and 43 is to find the square root of the output current and voltage from the amplifiers 39 and 42. While input power is detected, output power is fed into the power setter-comparator 33 for comparison with the preset power level. By so doing, produced power is always kept equal to the preset power level.

The oscillator 9 is of the electrostrictive type, producing high-frequency oscillations when actuated by the power from the output transformer 35. Each oscillator 9 oscillates at high frequencies the inner lining 24 through the connecting rod 10. Having the same oscillating characteristic, oscillators 9 are interchangeable. This feature not only permits considerable saving in equipment cost but also facilitates the design of mold oscillation pattern by simulation or other technologies.

Figure 13:
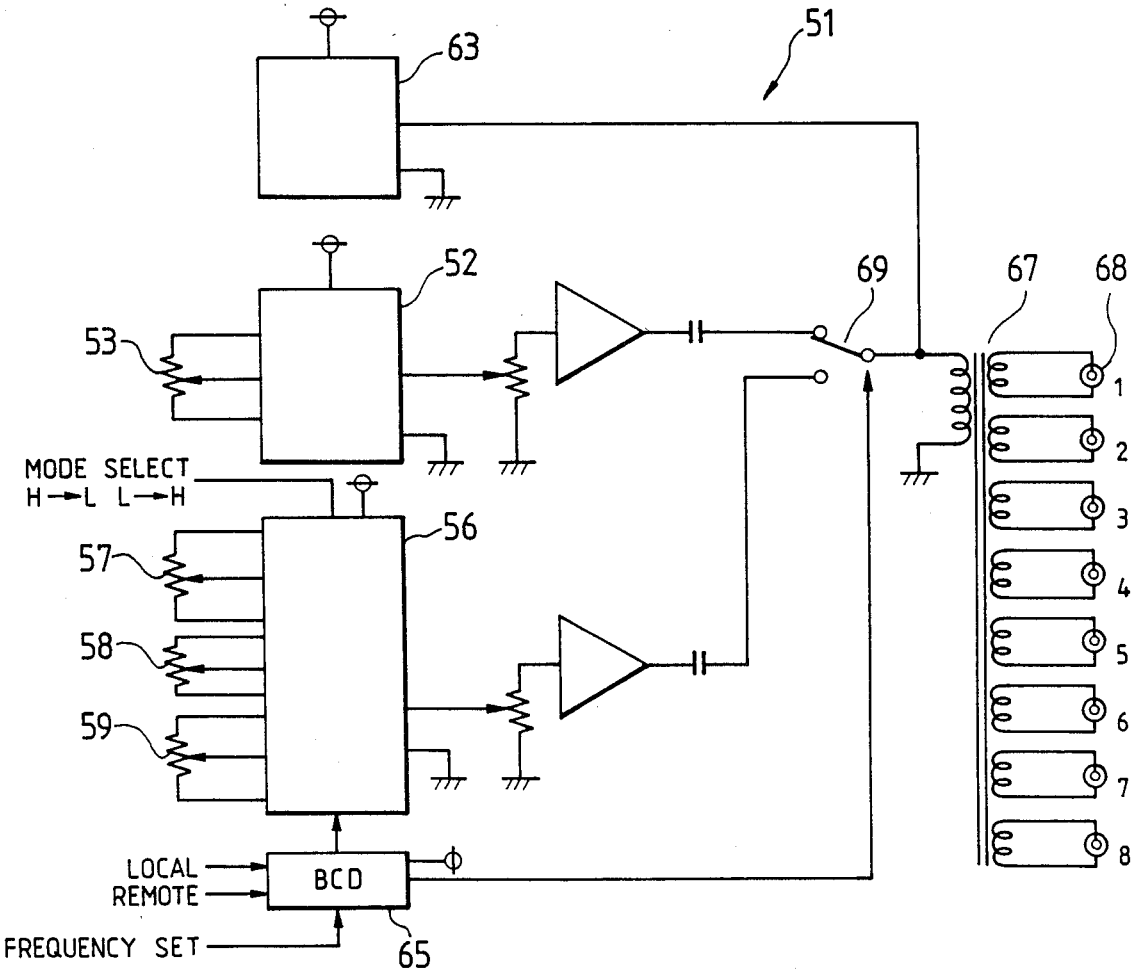
FIG. 13 is a circuit diagram showing an example of a frequency generator.

In addition to the frequency generator 32 connected to the power setter-comparator 33, a different frequency generator having a function, for example, to vary the frequency of oscillation with time may be provided separately. A frequency generator 51 shown in FIG. 13 is of the type just described. The frequency generator 51 consists essentially of a constant frequency generating circuit 52, a sweep generating circuit 56, a frequency counter 63, a BCD (binary coded decimal) system 65 and an output unit 67. The constant frequency generating circuit 52 equipped with a frequency setter 53 is used when there is no need to vary the frequency of oscillation with time. On the other hand, the sweep generating circuit 56 having a center frequency setter 57, a frequency scanning width setter 58 and a cycle period setter 59 is used when the frequency of oscillation must be varied with time. Switching from the constant frequency generating circuit 52 to the sweep generating circuit 56 and vice versa is accomplished by means of a changeover switch 69. The frequency counter 63 detects the frequency at which the inner lining 24 of the mold 21 is oscillated. On receiving remote instruction signals from a control panel (not shown), the BCD system 65 determines whether the oscillator 9 should be oscillated with constant frequency or sweep frequency and performs switching from one mode to the other. The output unit 67 has a plurality of output terminals 68, with each of which connected to the power setter-comparator 33 in the oscillating device 31. The output unit 67 sends out signals that determine the frequency of oscillations to be produced by the oscillator. The frequency generator 51 permits phase matching among a plurality of oscillators that produce oscillations of the same frequency. When oscillations of more than one frequency are produced, as many frequency generators 51 as the number of different frequencies involved are employed.

With the mold 21 and oscillating device 31 just described, liquid steel M is poured through a tundish (not shown) and an immersion nozzle 45 into the mold 21 while oscillating the inner lining 24 with the oscillators 9. Starting to solidify at a point where liquid steel M contacts the inner lining 24, liquid steel M forms a bloom M, which is then pulled out of the mold 21 by means of many pinch rolls 47 disposed below the mold.

Operation I

Figure 5:
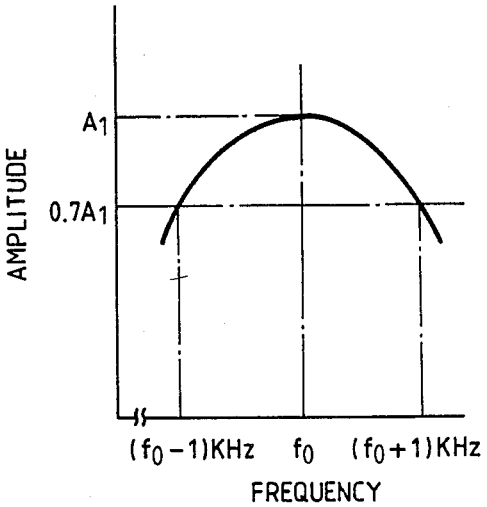
FIG. 5 graphically shows the relationship between the frequency and amplitude of oscillation produced by an oscillator.

Using the frequency setter, the frequencies of oscillations to be produced by the individual oscillators are set so that the frequencies for any two adjoining oscillators are not the same. Here, let us assume that maximum amplitude is obtained at frequency $f_0$. Then, if the frequency for an oscillator is set below $(f_0-1)$ KHz or above $(f_0+1)$ KHz, the amplitude of the high-frequency waves produced by that oscillator attenuates so sharply, as shown in FIG. 5, that the composite amplitude of the high-frequency waves produced by the individual oscillators also reduces remarkably. Accordingly, the amplitude of each oscillator should preferably be kept between the maximum amplitude $A_1$ and the amplitude equal to $A_1 \times 70\%$. To obtain such amplitude, frequency must be controlled within the range of 2 KHz between $(f_0-1)$ KHz and $(f_0+1)$ KHz, as is obvious from FIG. 5. Because the different frequencies for different oscillators are set within the range of $(f_0-1)$ KHz to $(f_0+1)$ KHz, the differences among the frequencies for the individual oscillators are not larger than 2 KHz.

Figure 3:
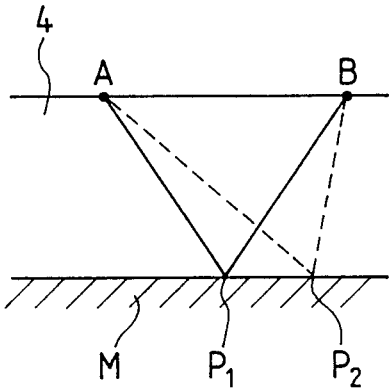
FIG. 3 illustrated the interference of high-frequency waves transmitted from two oscillators at the surface of a mold inner lining.
Figure 4:
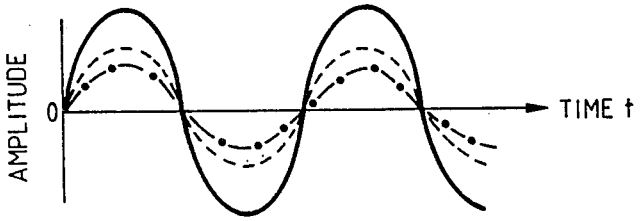
FIG. 4 PRIOR ART
FIGS. 4 (*a*) and (*b*) diagrammatically show conventional examples of composite oscillations resulting from the interference shown in FIG. 3.
Figure 4:
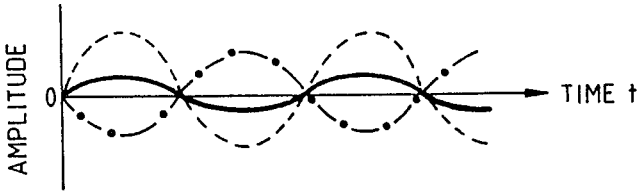
FIG. 4 PRIOR ART
Figure 14A:
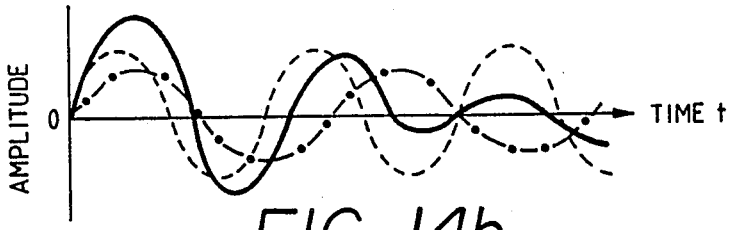
FIG. 14 diagrammatically shows amplitudes of composite oscillations produced by the method and apparatus of this invention.
Figure 14B:
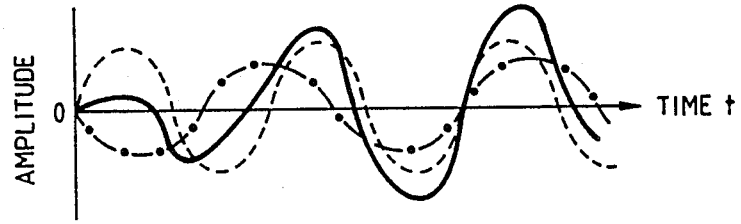

If the frequencies of oscillations produced by two adjoining oscillators are differentiated, as, for example, by increasing the frequency of oscillation produced by oscillator A as shown in FIG. 3, the relative phases of the high-frequency waves produced by oscillators A and B vary every moment. Therefore, the oscillations produced by the two oscillators do not always overlap each other at point $P_1$, as shown in FIGS. 14 (*a*) and (*b*). Similarly, the oscillations from the two oscillators do not always cancel each other at point $P_2$, thus producing an oscillation of a composite amplitude as at point $P_1$.

The example just described involved two oscillators. Now, the composite amplitude $A_o$ that may be obtained when m pieces of oscillators producing oscillations of the same frequency are provided is expressed as follows:

$$A_o = \Sigma A_n \cos\left\{\omega\left(t - \frac{|l_n - x|}{v}\right)\right\} \cdot e^{-a_n(|l_n - x|)} \quad (5)$$

where $A_n$=position-dependent coefficient of amplitude for oscillators excited by the same power $\omega = 2f\pi$(where f=frequency of oscillation in Hz)

t=elapsed oscillating time (second)

Figure 15A:
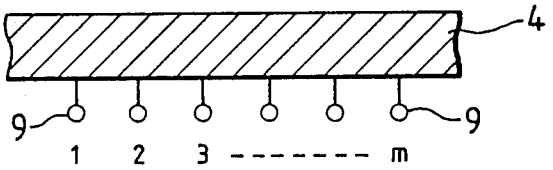
FIGS. 15 (*a*), (*b*) and (*c*) diagrammatically show the arrangement of m pieces of oscillators and the amplitude of composite oscillations produced thereby.
Figure 15B:
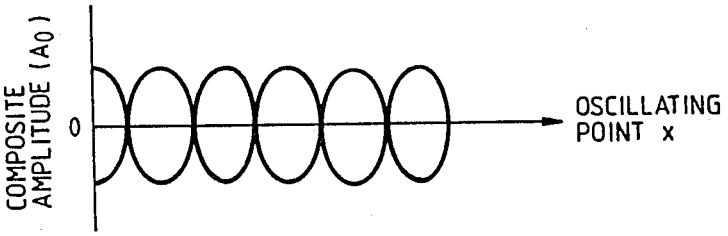
Figure 15C:
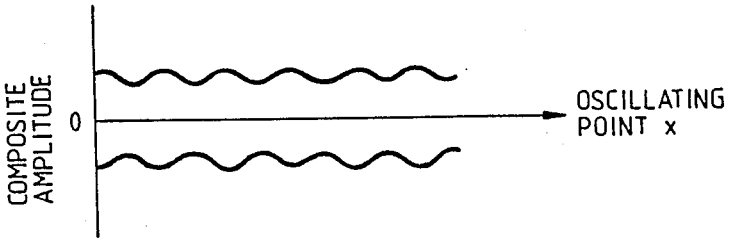
Figure 16A:
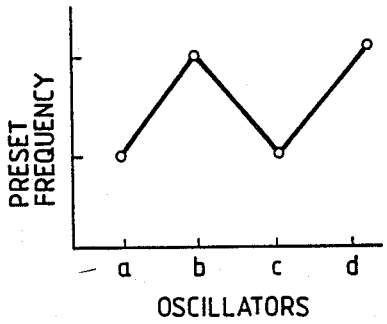
FIGS. 16 (*a*)–(*e*) graphically shows models of set frequencies for different oscillators on a mold.
Figure 16D:
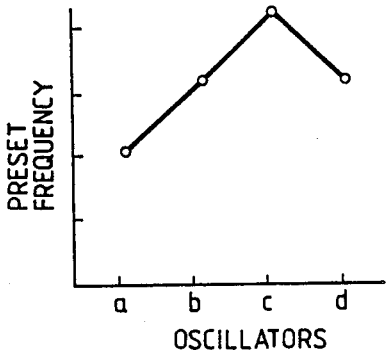
Figure 16B:
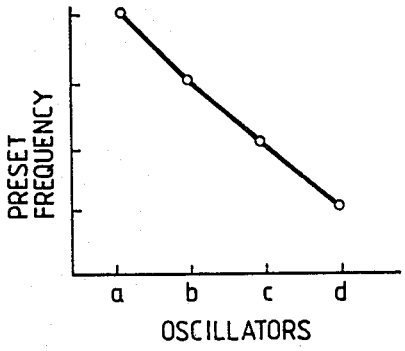
Figure 16E:
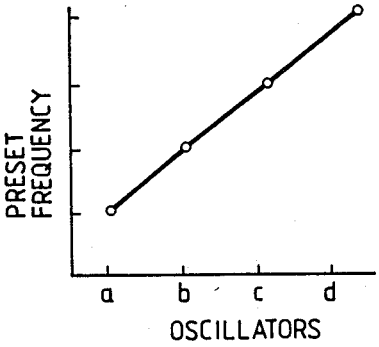
Figure 16C:
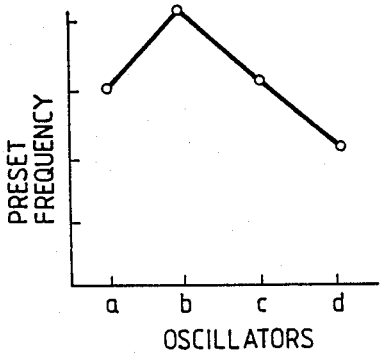

$l_n$=distance between No. 1 oscillator and any other oscillator x=oscillating point plotted from the origin at which No. 1 oscillator is positioned v=speed with which sound wave propagates through the mold $a_n$=coefficient of attenuation of the amplitude of each oscillator propagating to other parts This composite amplitude can be expressed as shown at (*b*) of FIG. 15 with respect to the oscillating point x on the mold. As is obvious, the composite amplitude is always low in some localized areas.

Even so, a flat amplitude distribution throughout the entirety of the inner lining can be obtained, as shown at (*c*) of FIG. 15, by varying the frequency of oscillations produced by adjoining oscillators. This leaves no spot of the inner lining unoscillated.

The appropriate frequency of oscillation is from 5 KHz to 50 KHz. If frequency is under 5 KHz, audible sound will exceed the level appropriate for the working environment. If, on the other hand, frequency is over 50 KHz, friction between the mold and the solidifying shell will not be reduced. The difference in frequency between individual oscillators is 2 KHz maximum, as mentioned before, and 0.01 KHz minimum. The desired effect will not be obtained if frequency is below 0.01 KHz.

The inner lining of the mold should preferably be oscillated with an amplitude of $1\mu$ or over. So long as adequate power is supplied and the amplitude of oscillation is not smaller than $1\mu$, oscillators producing oscillations of different frequencies may be disposed in any way. But if supplied power is inadequate for obtaining the desired amplitude, the frequency of oscillations produced by other oscillators than the base oscillator must be gradually decreased or increased with the distance of such oscillators from the base oscillator. This arrangement permits the mold to be oscillated with large amplitude despite the inadequate power supply. Because the directional amplitude distribution of beat frequency repeatedly changes with time, a uniform desirable amplitude distribution is obtainable at given intervals in all areas of the mold.

Figure 1:
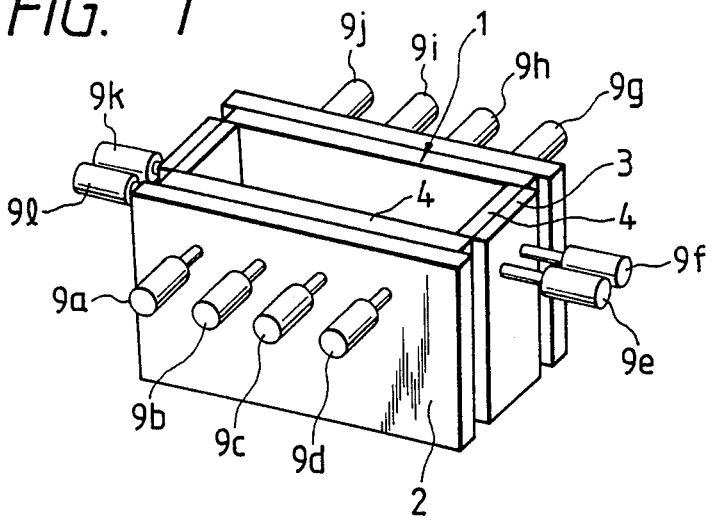
FIG. 1 is a perspective view of an oscillated continuous caster mold equipped with a plurality of oscillators.
Figure 2:
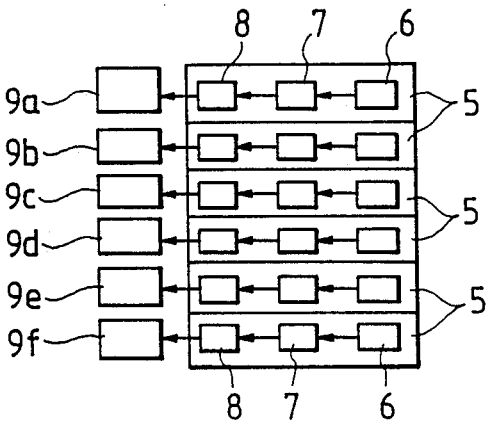
FIG. 2 is a schematic diagram of oscillators attached to a continuous caster mold.

FIG. 16 shows models of frequency for individual oscillators under the condition just described. Graph (*a*) of FIG. 16 shows an example in which the frequencies for oscillators 9*a* to 9*b* in FIG. 1 are varied disorderly. Graph (b) shows an example in which oscillator 9*a* is chosen as the base oscillator. The frequency of oscillation for oscillators 9b, 9c and 9d is gradually decreased as the distance from the base oscillator 9a increases. Graph (c) shows a similar example in which oscillator 9b serves as the base oscillator. Graph (d) shows another similar example in which oscillator 9c serves as the base oscillator. Graph (e) shows still another similar example in which oscillator 9d serves as the base oscillator. The amplitude distribution of beat frequency in case (a) has no directionality. Therefore, the effect obtained in case (a) is smaller than the effects in cases (b) to (e) in which the amplitude distribution of beat frequency is directional.

Figure 17:
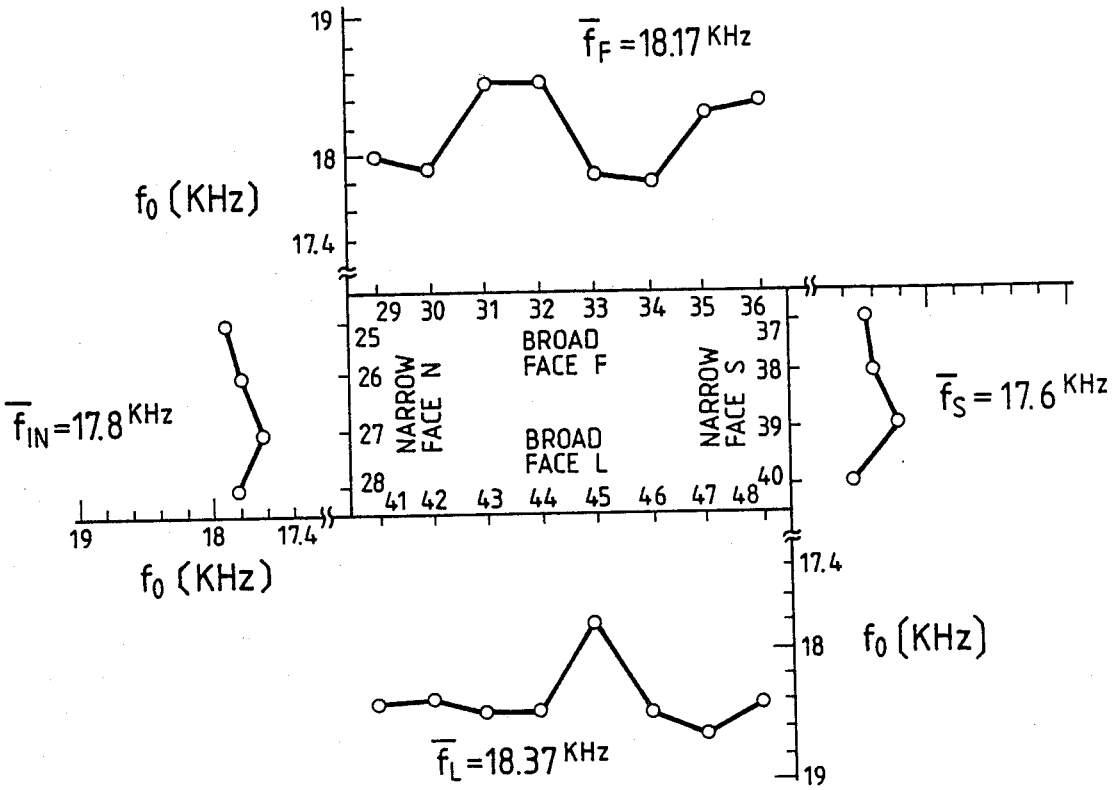
FIG. 17 graphically shows an example of resonance frequency that is measured in determining the reference frequency.

A more concrete frequency setting method, together with some examples of set frequencies, will be described now. First, reference frequency is determined by oscillating the inner lining by means of oscillators disposed around the periphery of the mold at appropriate intervals. A given amount of power is supplied to the oscillators, one at a time. A point at which current supply to the oscillator becomes minimum is chosen as the dip point. The frequency at the dip point is defined as the resonance frequency. The mean of the resonance frequencies for all oscillators mounted on the mold is defined as the reference frequency. FIG. 17 shows an example of frequency measured at the dip point In this example, the base frequency obtained by averaging all resonance frequencies was 18.1 KHz. Next, frequencies determined on the basis of the reference frequency are assigned to the individual oscillators, within the limits of 2 KHz. The variety of assigned frequencies is determined according to the size of the mold, performance of the oscillators and other parameters. Usually, two to six different frequencies are assigned. The frequencies thus chosen are assigned to individual oscillators by considering the size of the mold, performance of the oscillators and other parameters. In the aforementioned example, two frequencies, one of which being the reference frequency of 18.1 KHz, were used. The other frequency that affords the maximum amplitude was empirically determined on the basis of the reference frequency of 18.1 KHz. The other frequency thus determined was 18.5 KHz. When three different frequencies are used, an intermediate frequency between the other two is chosen as a third frequency. In the example being described, for instance, the three frequencies are 18.1 KHz, 18.3 KHz and 18.5 KHz. When four different frequencies are used, a third and a fourth frequency are determined by equally dividing the range between the other two frequencies. In the example being described, the four frequencies are 18.1 KHz, 18.23 KHz, 18.36 KHz and 18.5 KHz.

Assignment of frequencies should not be limited to the method just described. For example, two frequencies may be such that are equally away from the reference frequency on both sides thereof, each affording the maximum amplitude. Such frequencies are empirically determined on each mold. If the reference frequency is 18.1 KHz, for example, the two frequencies may be 17.9 KHz and 18.3 KHz. When three or four frequencies are used, the remaining one or two frequencies are determined by equally dividing the difference of 0.4 KHz between 17.9 KHz and 18.3 KHz.

Figure 19:
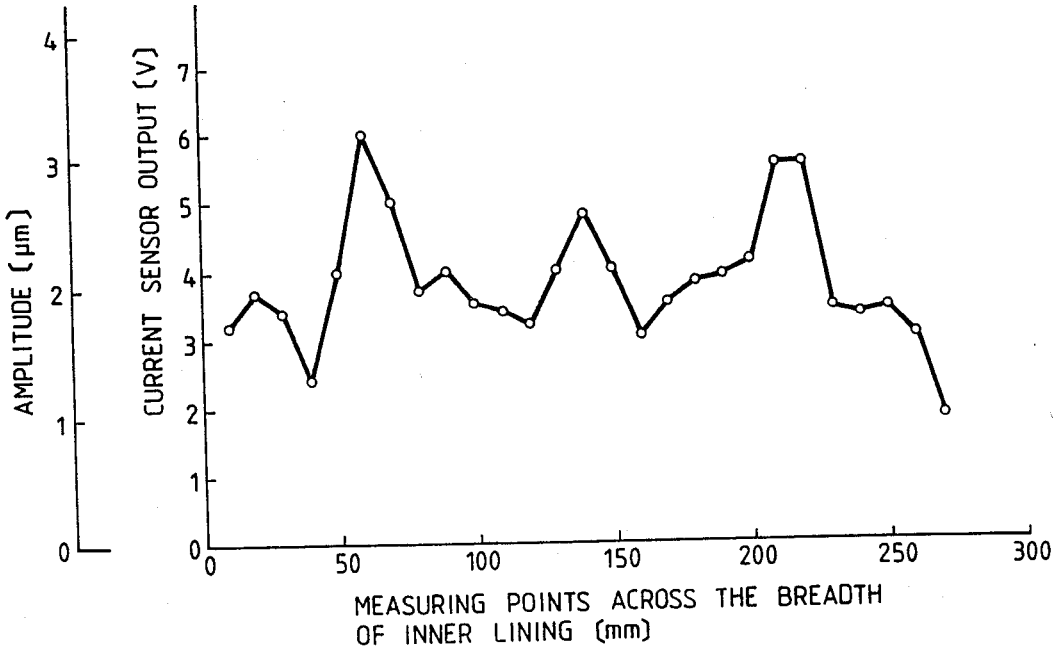
FIG. 19 shows the distribution of amplitudes with a mold inner lining oscillated by four oscillators producing oscillations of different frequencies.
Figures 18A, 18B:
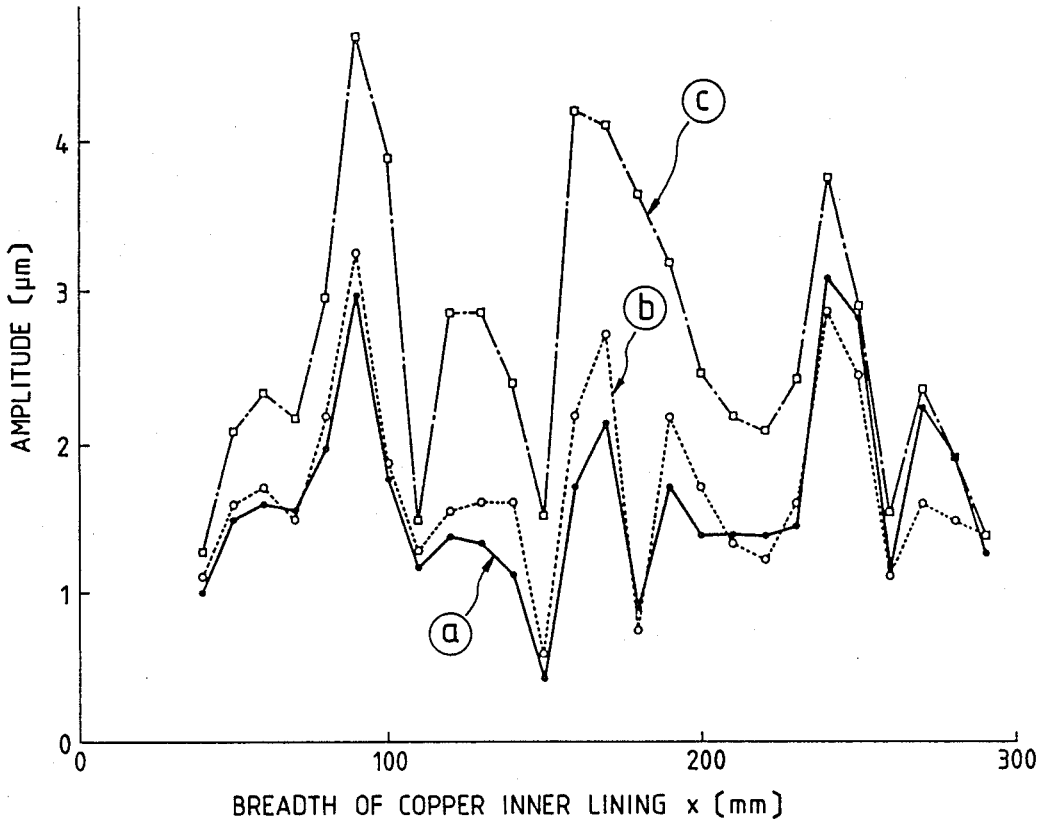
FIG. 18*a* shows the distribution of amplitudes that varies with the position of three oscillators producing oscillations of different frequencies.
FIG. 18*b* shows the points at which the three oscillators are positioned.

FIGS. 18 (*a*) and (*b*) show an example in which three frequencies are used. In case (c), the frequencies for other oscillators than the base oscillator are gradually decreased with the distance from the base oscillator. As is obviously illustrated, the amplitude in case (c) is much larger than in cases (a) and (b) in which oscillators are arranged differently. FIG. 19 shows a case in which four different frequencies are used, with the frequencies for other oscillators than the base oscillator being gradually decreased with the distance from the base oscillator.

Figure 6:
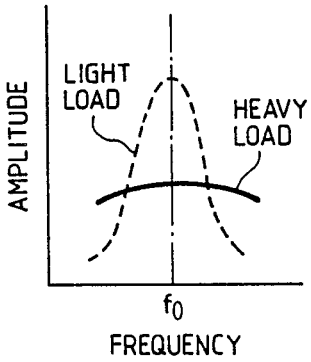
FIG. 6 graphically shows the relationship between frequency and amplitude, using the applied load as the parameter.
Figure 7:
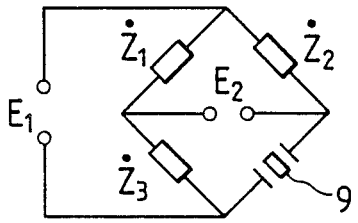
FIG. 7 shows a bridge circuit to detect the amplitude of oscillation.
Figure 8:
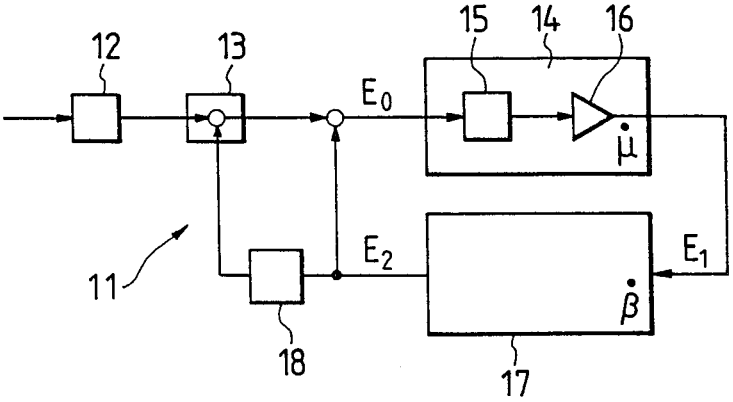
FIG. 8 PRIOR ART
FIG. 8 is a block diagram of a conventional automatic frequency tracking constant amplitude controller.
Figure 20:
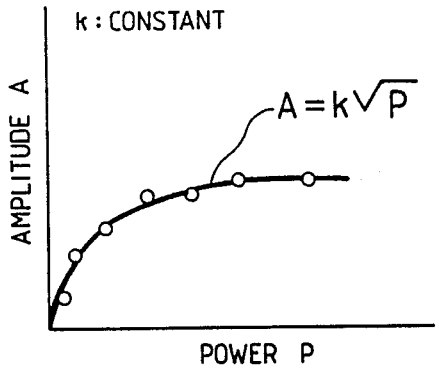
FIG. 20 graphically shows the empirically confirmed relationship between power (voltage times current) and amplitude.
Figure 21A:
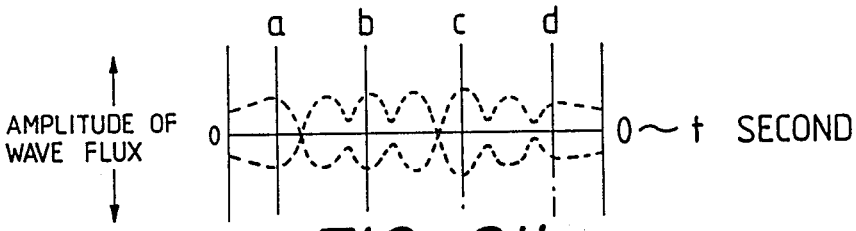
FIGS. 21 (*a*)–(*e*) graphically show the maximum amplitudes at different points of a mold inner lining at different time.
Figure 21B:
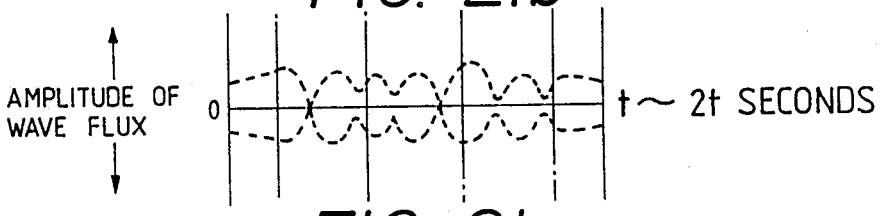
Figure 21C:
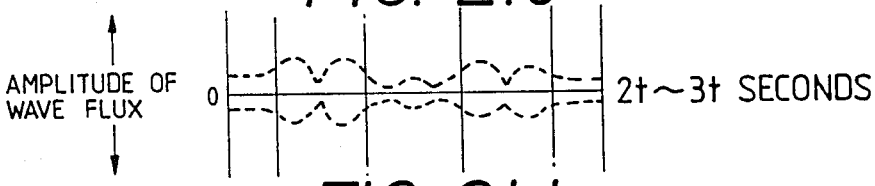
Figure 21D:
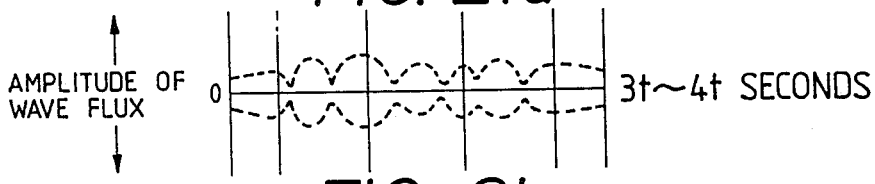
Figure 21E:
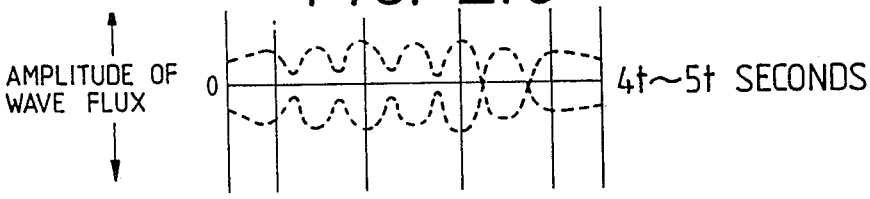

In oscillating the inner lining, it is preferable that the amplitude of the oscillator is constant. Now a method of controlling the amplitude of inner lining oscillation will be described. The oscillation of a mole inner lining requires a heavier load than that of, for example, an ultrasonic cleaner. As shown n FIG. 6, amplitude changes less with respect to frequency as the load increases (as indicated by solid line). Therefore, amplitude changes less even when frequency varies. The following relationship between the output power P of the oscillating device (voltage times current on the primary side of the output transformer) and amplitude A determined under heavily loaded conditions is as follows (see FIG. 20):

$$A = k\sqrt{P} \text{ (where } k = \text{coefficient)} \quad (6)$$

An oscillating device 31 shown in FIG. 12 always keeps output power at the preset power level, as described previously. Keeping output power at a constant level permits keeping the amplitude of frequency at a substantially constant level. Output power may vary when impedance varies before or after liquid metal is poured or when the temperature of the oscillator varies. Even under such conditions, the amplitude of frequency can be maintained at a substantially constant level by means of constant power control.

Operation II

Attenuation of amplitude in the trough of a standing wave reduces if the mold is oscillated by oscillators assigned with different frequencies varied within the range of $(f_0-1)$ KHz to $(f_0+1)$ KHz as mentioned before. Depending on the size of the mold, performance of the oscillating device and other parameters, however, the resulting composite amplitude might make no cyclic motion unless some special provision is made. Then, some portions of the mold inner lining may be oscillated with large amplitudes, but other portions will be at all times oscillated with small amplitudes. Liquid metal sticks to the oscillated mold where the amplitude of oscillation is small. But the amplitude of oscillation can be increased by changing the frequency of oscillations of individual oscillators with time.

Now a to d in the following represent the oscillators 9a to 9d in FIG. 1 that have the same oscillating characteristic.

The frequencies of oscillations produced by the individual oscillators at a specific time $T_1$ are as follows:

a: $\nu_a$, b: $\nu_b$, c: $\nu_c$, and d: $\nu_d$

Then, $\nu_a$ to $\nu_d$ can be set as follows by adjusting the frequency generator connected to each oscillator:

$$\nu_{max} - \nu_{min} < 2 \text{ KHz} \quad (7)$$

where $\nu_{max}$ = the highest frequency among $\nu_a$, $\nu_b$, $\nu_c$ and $\nu_d$, and $\nu_{min}$ = the lowest frequency among $\nu_a$, $\nu_b$, $\nu_c$ and $\nu_d$ $\nu_a$ to $\nu_d$ are set so that (8)

-continued $$\nu_a \neq \nu_b,\ \nu_b \neq \nu_c \text{ and } \nu_c \neq \nu_d$$

At time $T_2$ a fraction of second t (for example, from 0.1 second to 1 second) after time $T_1$, oscillation frequencies of the oscillators are changed as follows:

$$\text{a: } \nu_a',\ \text{b: } \nu_b',\ \text{c: } \nu_c',\ \text{and d: } \nu_d'$$

$\nu_a'$ to $\nu_d'$ are all set to satisfy equations (7) and (8).

Oscillation frequencies of the oscillators are again changed as follows a fraction of second t after time $T_2$:

$$\text{a: } \nu_a'',\ \text{b: } \nu_b'',\ \text{c: } \nu_c'',\ \text{and d: } \nu_d''$$

$\nu_a''$ to $\nu_d''$ are also set to satisfy equations (7) and (8). Here, oscillation frequencies of the oscillators may be returned to the original ones; i.e., $$\nu_a=\nu_a'',\ \nu_b=\nu_b'',\ \nu_c=\nu_c'' \text{ and } \nu_d=\nu_d''.$$

In the same way, the frequencies of oscillations with which the inner lining of the mold is oscillated are changed with time, either intermittently or continuously.

The same procedures as for the oscillators 9a to 9e are applied to the oscillators 9e to 9l.

FIG. 21 shows the oscillating conditions of a mold oscillated at the following frequencies by the oscillators 9a to 9d.

$$\text{a: } \nu_a \text{ KHz, b: } (\nu_a-1) \text{ KHz, c: } \nu_a \text{ KHz and d: } (\nu_a-1) \text{ Khz}$$

Figure 22A:
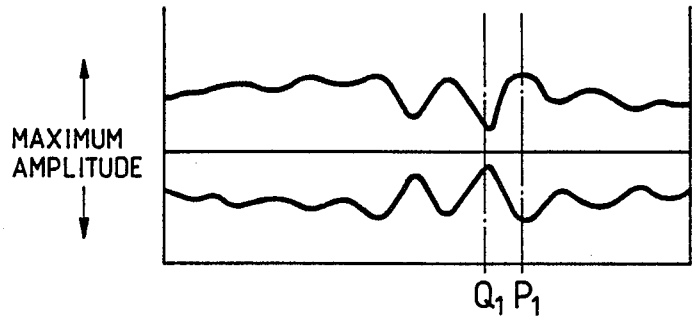
In FIG. 22, (*a*) graphically shows the maximum amplitudes at different points of a mold oscillated in the pattern shown in FIG. 21; (*b*) is a similar graph obtained with a different oscillation pattern; (*c*) is a similar graph obtained by intermittently alternating the patterns (*a*) and (*b*)
Figure 22B:
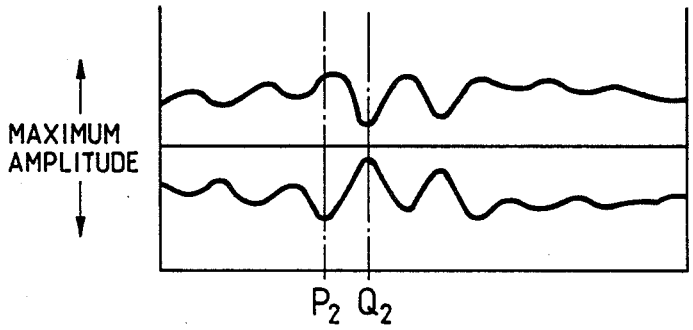
Figure 22C:
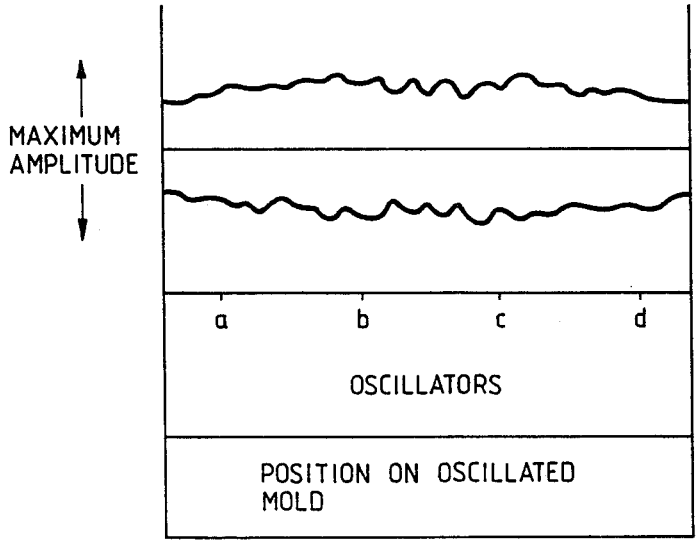

FIG. 21 shows the oscillating condition up to a fraction of second t after the start of oscillation at (a), that between a fraction of second t and 2 seconds after the start at (b), that between 2 seconds and 3 seconds after the start at (c), that between 3 seconds and 4 seconds after the start at (d) and that between 4 seconds and 5 seconds after the start at (e). Dotted lines in each graph defines the range of maximum amplitude in each time span. Overlapping each other, oscillations of the individual oscillators form the wave fluxes as indicated by dotted lines in FIG. 21. The wave fluxes change with time as shown at (a) through (d), competing a whole cycle at (e). The cycle consisting of steps (a) to (e) is repeated with the passage of time. Graph (a) of FIG. 22 shows the contour that is obtained when curves in (a) to (e) of FIG. 21 are drawn, one over another, in one chart. This shows the maximum amplitude attained at different points of a mold in the course of one cycle. Graph (a) of FIG. 22 shows that point $P_1$ of the mold is always oscillated with a favorable large amplitude. In contrast, point $Q_1$ is always oscillated with an undesirable small amplitude. This means that seizure or sticking of liquid metal is likely to occur at point $Q_1$.

Graph (b) of FIG. 22 shows the maximum amplitude attained at different points of a mold in the course of one cycle with the following setting:

$$\text{a: } \nu_a \text{ KHz, b: } (\nu_a+1) \text{ KHz, c: } \nu_a \text{ KHz and d: } (\nu_a+1) \text{ KHz.}$$

With this change in frequency, the points at which the mold is oscillated with a large and a small amplitude shift to $P_2$ and $Q_2$ respectively, as shown in (b) of FIG. 22. Graph (c) of FIG. 22 shows the contour that is obtained when curves (a) and (b) of FIG. 22 are drawn, one over the other, in one chart. First, the oscillation frequency of each oscillator is set at a given level for a fraction of second $t_1$ (for example, between 0.1 second and 1 second) as shown in (a) of FIG. 22. Then, the oscillation frequency of each oscillator is kept at another level for a fraction of second $t_2$ (for example, between 0.1 second and 1 second) as shown in (b) of FIG. 22. Consequently, the maximum amplitude of oscillation applied to the mold during the period $t_1+t_2$ becomes uniform throughout the mold, whereby no point of the mold is any longer oscillated with small amplitudes.

Localized spots constantly oscillated with small amplitudes can thus be eliminated by changing the oscillation frequencies of of individual oscillators in the course of the oscillating operation. The oscillation frequency of each oscillator can be varied with time by use of the frequency generator 51 shown in FIG. 13. For example, the center frequency setter 57 sets frequency $\nu_a$ and the frequency scanning width setter 58 sets frequency $\nu_a'$. The cycle period setter 59 sets a cycle period t with which frequency $\nu_a$ is switched to frequency $\nu_a'$.

When a mold is oscillated by a plurality of oscillators having the same oscillating characteristic, with the oscillation frequencies of the oscillators set within the range of $(f_0-1)$ KHz to $(f_1+1)$ KHz, the operating method just described assures that the entire mold is uniformly oscillated with large amplitudes, leaving no localized spots where the amplitude of oscillation is undesirably small.

Operation III

It is also possible to vary with time the oscillation frequencies of oscillators as follows: Any of the oscillators 9a to 9d shown in FIG. 1 may be chosen as the base oscillator. If the oscillator 9a is chosen as the base oscillator, the oscillation frequencies of the oscillators at a specific time $T_1$ are set according to setting I.

Then, equation (7) becomes $$0<\nu_a-\nu_d<2 \text{ KHz} \tag{7'}$$

Similarly, equation (8) becomes $$\nu_a>\nu_b>\nu_c>\nu_d \tag{8'}$$

At time $T_2$, which is t second (for example, from 0.5 second to 2 seconds) after time $T_1$, the oscillation frequencies of the oscillators are changed to setting II that satisfies equations (7'') and (8'') given below.

$$0<\nu_d'-\nu_a'<2 \text{ KHz} \tag{7''}$$

$$\nu_a'<\nu_b'<\nu_c'<\nu_d' \tag{8''}$$

Then again, t second after $T_2$, the oscillation frequencies of the oscillators are changed as follows: $\nu_a''=\nu_a$, $\nu_b''=\nu_b$, $\nu_c''=\nu_c$ and $\nu_d''=\nu_d$. Accordingly, equations (7') and (8') are applicable to $\nu_a''$ to $\nu_d''$, as well.

Oscillation of the mold is continued by intermittently or continuously switching, with time, from setting I to setting II, and then from setting II to setting I, and so forth.

Figure 23A:
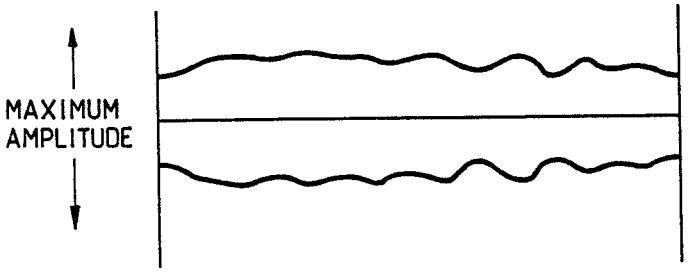
In FIG. 23, (*a*) graphically shows the maximum amplitudes at different points of a mold oscillated whose frequency of oscillation is varied with time as set under condition I; (*b*) is a similar graph obtained with the setting under condition II; (*c*) is a similar graph obtained by intermittently alternating the settings under conditions I and II.
Figure 23B:
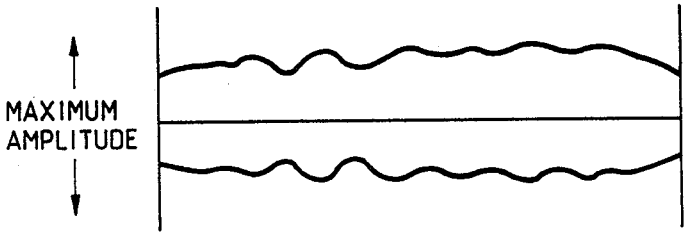
Figure 23C:
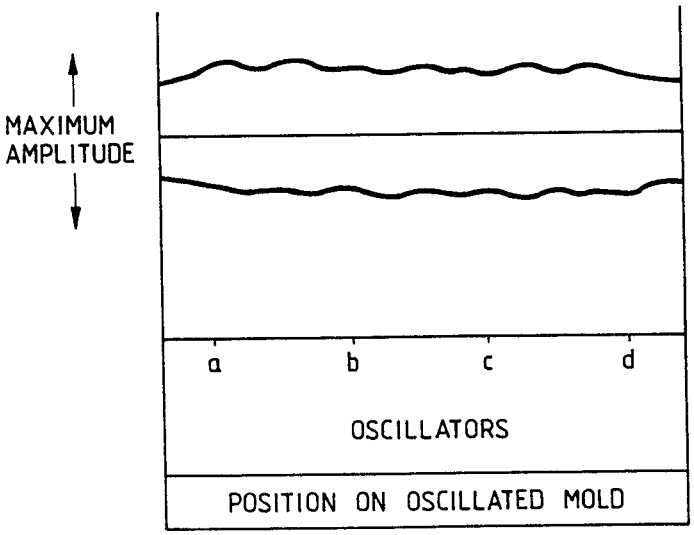

Graph (a) in FIG. 23 shows the maximum amplitude attained in the course of a single cycle at different points of a mold oscillated with setting I. in which oscillator a serves as the base oscillator and a: $\nu_a$ KHz, b: $(\nu_a=0.3)$ KHz, c: $(\nu_a-0.6)$ KHz and d: $(\nu_a-0.9)$ KHz. The wave flux with setting I forms a beat wave that moves from oscillator a to oscillator b with a group velocity. Therefore, maximum amplitudes obtained during a single cycle at different points of the mold are more uniform than those shown in graph (a) of FIG. 22. After the oscillation frequencies of the oscillators have been maintained as shown in (a) of FIG. 22 for the period of $t_3$ second, setting is changed to II, in which a: $\nu_a$ KHz, b: $(\nu_a+0.3)$ KHz, c: $(\nu_a+0.6)$ KHz and d: $(\nu_a+0.9)$ KHz. Graph (b) of FIG. 23 shows the distribution of maximum amplitudes at different points of the mold that is obtained when setting II is maintained for a period of $t_4$ second. Graph (c) of FIG. 23 shows the contour that is obtained when curves in (a) and (b) of FIG. 23 are drawn, one over the other, in a single chart. The contour shows the maximum amplitudes of oscillation applied to different points of the mold during the period $t_3+t_4$. As can be seen, the amplitude distribution in (c) of FIG. 23 is more uniform than that shown in (c) of FIG. 22.

Figure 24A:
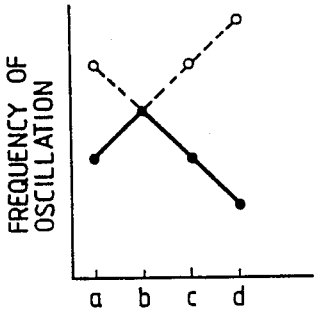
FIGS. 24 (*a*), (*b*) and (*c*) graphically show how the frequency of oscillations produced by different oscillators varies as the base oscillator is changed.
Figure 24B:
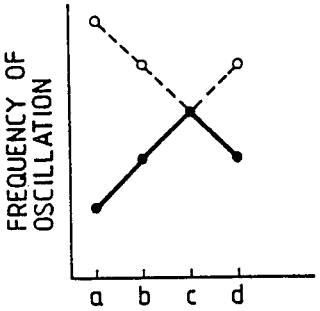
Figure 24C:
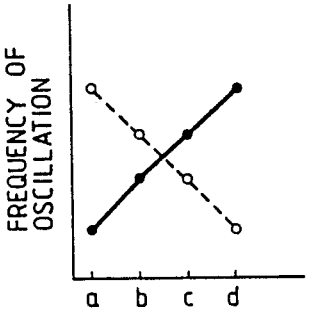

FIG. 24 shows different examples in which different oscillators serve as the base oscillator. The oscillator 9b serves as the base oscillator in (a), the oscillator 9c in (b), and the oscillator 9d in (c). While solid line indicates setting I, dotted line shows setting II.

Oscillator Monitoring Device

Figure 25A:
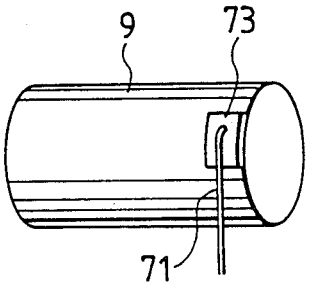
In FIG. 25, (*a*) is a perspective view of an oscillator equipped with a thermocouple, and (*b*) ia a front view of the same oscillator.
Figure 25B:
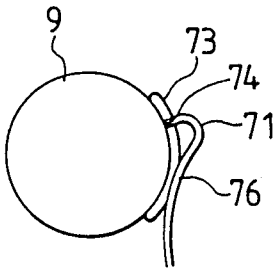

FIG. 25 shows an example of an oscillator equipped with a thermocouple at (a) and (b). A thermocouple 71 is fastened to a plate 73, with the tip of the thermocouple 71 inserted into a hole 74 provided in the plate 73. A fastener 76 prevents the thermocouple 71 from coming off the plate 73. The plate 73 carrying the fastened thermocouple 71 is fastened to an oscillator 9 by means of resin or other adhesive.

Figure 26:
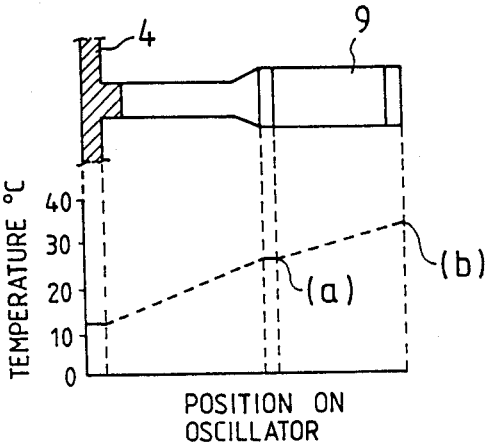
FIG. 26 graphically shows an example of the surface temperature distribution in an oscillator at work.

FIG. 26 shows an example of surface temperature distribution in an oscillator at work. The temperature distribution curves shown in (a) and (b) of FIG. 26 will change when the amplitude of the oscillator 9 is varied. In the vicinity of the tip (b), for example, a highly reproducible surface temperature having a close correlationship with amplitude appears. As such, the operation of the oscillator 9 is monitored, using the surface temperature determined at a specific point on the surface thereof as a parameter. If the relationship between the surface temperature and amplitude of each oscillator 9 has been grasped in advance, high-precision monitoring will become possible.

Figure 27:
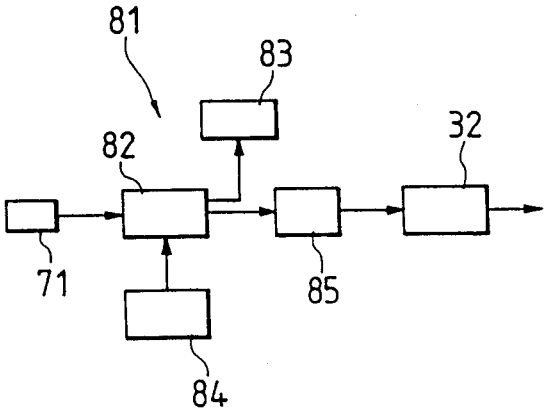
FIG. 27 is a block diagram showing an example of a monitoring system.

FIG. 27 is an overall block diagram of a monitoring system. The data on the surface temperature of the oscillator obtained by a thermocouple 71 is sent to a surface temperature checking device 82. A surface temperature limit setter 84 sets the upper and lower limits of the surface temperature of an oscillator. A warning device 83 sets off an alarm when the surface temperature checking device 82 finds that the surface temperature of the oscillator is either above the upper limit or below the lower limit. An arithmetic unit 85 performs arithmetic processing on the delivered temperature information, with the result output to the power setting-comparator 33 shown in FIG. 12.

This invention should not be considered as being limited to the examples described hereabove. For example, this invention is applicable to the continuous casting of billets or slabs, instead of blooms. Also, the oscillators may be of the magnetostrictive type, instead of the electrostrictive type.

What is claimed is:

1. A method of oscillating a continuous caster mold at high frequencies which comprises:

disposing a plurality of oscillators having substantially the same oscillating characteristic at intervals along or in the vicinity of a line where liquid metal contacts an inner lining of a mold;

connecting the tip of each oscillator to the inner lining so that the axis of the oscillator extends at right angles to the surface of the inner lining; and supplying power from an oscillation generator to each oscillator so that the oscillation frequencies of any two adjoining oscillators are differentiated within the limit of 2 KHz, whereby any two adjoining oscillators oscillate the inner lining at right angles to the surface thereof at mutually differentiated frequencies.

2. A high-frequency mold oscillating method according to claim 1, in which one oscillator is chosen as the base oscillator, the frequency with which other oscillators than the base oscillator oscillate the inner lining being gradually decreased with the distance from the base oscillator.

3. A high-frequency mold oscillating method according to claim 1, in which one oscillator is chosen as the base oscillator, the frequency with which other oscillators than the base oscillator oscillate the inner the inner lining being gradually increased with the distance from the base oscillator.

4. A high-frequency mold oscillating method according to claim 1, in which the frequency with which each oscillator oscillates the inner lining is intermittently or continuously varied with time.

5. A high-frequency mold oscillating method according to claim 1, in which one oscillator is chosen as the base oscillator and the oscillating mode of the inner lining is intermittently or continuously switched with time from a first oscillating mode in which the frequency with which other oscillators than the base oscillator oscillate the inner lining is gradually decreased with the distance from the base oscillator to a second oscillating mode in which the frequency with which other oscillators than the base oscillator oscillate the inner lining is gradually increased with the distance from the base oscillator, and vice versa.

6. A high-frequency mold oscillating method according to claim 1, in which electric power is supplied to each oscillator through a high-frequency output transformer, the product of d.c. voltage and d.c. current on the primary side of the high-frequency output transformer being controlled so that the amplitude of each oscillator is kept constant.

7. A high-frequency mold oscillating method according to claim 6, in which the d.c. voltage and d.c. current on the primary side of the high-frequency output transformer are detected for use in the feedback control of the product thereof.

8. A continuous caster mold oscillated at high frequencies, comprising:

outer walls;

an inner lining of copper or copper alloy backed up by the outer walls, a cooling water passage being provided between the inner lining and the outer walls;

a plurality of oscillators having substantially the same oscillating characteristic that are disposed at intervals along or in the vicinity of the surface of the liquid metal bath, the tip of each oscillator being connected to the inner lining at right angles to the surface thereof; and an oscillation generator that supplies power to each oscillator so that any two adjoining oscillators oscillate at different frequencies differentiated within the limit of 2 KHz.

9. A high-frequency oscillated continuous caster mold according to claim 8, in which the water-cooled surface of the inner lining is coated with a layer of nickel plating or layer consisting of an under-coating of nickel plating and an over-coating of chromium coating.

10. A high-frequency oscillated continuous caster mold according to claim 8, which comprises a high-frequency generator, a power setter-comparator connected to the high-frequency generator, an inverter connected to the power setter-comparator, the inverter being triggered by the high-frequency generator so that each oscillator is actuated at a desired frequency, a high-frequency output transformer connected to the inverter to supply power to each oscillator, a power control circuit that outputs preset power to the power setter-comparator and means detecting the d.c. voltage and d.c. current from the inverter and outputting the same d.c. voltage and d.c. current to the power control circuit, in which the power output from the inverter to the high-frequency output transformer is controlled so that the amplitude of each oscillator is kept constant.

11. A high-frequency oscillated continuous caster mold according to claim 8, which comprises a temperature detector that determines the surface temperature of each oscillator, a surface temperature checker that checks if the surface temperature of each oscillator is within a desired range, and a warning device that sets off an alarm when the surface temperature of each oscillator is outside the desired range.

* * * * *